United States Patent [19]

Tanaka et al.

[11] Patent Number: 4,550,879

[45] Date of Patent: Nov. 5, 1985

[54] VERTICAL TYPE PULVERIZING AND CLASSIFYING APPARATUS

[75] Inventors: Akio Tanaka, Hirakata; Yasuo Kamo, Sakura, both of Japan

[73] Assignee: Kabushiki Kaisha Hosokawa Funtai Kogaku Kenkyusho, Osaka, Japan

[21] Appl. No.: 578,976

[22] Filed: Feb. 10, 1984

[30] Foreign Application Priority Data

Feb. 10, 1983 [JP] Japan ..... 58-21911

[51] Int. Cl.[4] ..... B02C 23/32

[52] U.S. Cl. ..... 241/52; 241/80; 241/97

[58] Field of Search ..... 241/80, 97, 79.1, 53, 241/48, 52, 57, 58, 5

[56] References Cited

U.S. PATENT DOCUMENTS 3,071,330 1/1963 Jackering ..... 241/53

3,285,523 11/1966 Duyckinck et al. ..... 241/53

4,451,005 5/1984 Urayama ..... 241/80 X

*Primary Examiner*—Mark Rosenbaum

*Attorney, Agent, or Firm*—Edwin E. Greigg

[57] ABSTRACT

The invention provides an improved vertical type pulverizing and classifying apparatus comprising a lower, pulverizing chamber and an upper, classifying chamber, wherein a material under treatment is carried by gas streams. The disclosed apparatus includes a conduit between the pulverizing chamber and the classifying chamber for sending particles of the material emerging from a primary classification to the classifying chamber for a secondary classification. A floating chamber is provided circumferentially of the conduit to receive particles descending from the classifying chamber for a further classification, whereby resulting fine particles are blown back to the classifying chamber and coarse particles are returned to the pulverizing chamber by way of a material feeder.

6 Claims, 2 Drawing Figures

VERTICAL TYPE PULVERIZING AND CLASSIFYING APPARATUS

BACKGROUND OF THE INVENTION

This invention relates to an improvement in a vertical type pulverizing and classifying apparatus comprising a pulverizing chamber, a pluverizing rotor mounted in the pulverizing chamber to be rotatable on a vertical axis, a material feeder and a material carrying gas feed duct both connected to the pulverizing chamber, a guide ring mounted in the pulverizing chamber and directly over the rotor to be substantially coaxial with the vertical axis, the guide ring defining a gas stream ascending passage circumferentially thereof and a gas stream descending passage inwardly thereof, a classifying blade rotor rotatable substantially on the vertical axis to provide a secondary classification of fine particles of a material under treatment resulting from a primary classification effected in the gas stream descending passage, a collecting passage for removing fine particles separated out by the classifying blade rotor, and a return passage for returning coarse particles to the pulverizing chamber.

In the apparatus having such a construction, the material introduced into the pulverizing chamber by the material feeder is pulverized by the pulverizing rotor therein and the pulverized material is carried by gas streams entering from the gas feed duct, through the gas stream ascending passage defined outwardly of the guide ring and through the gas stream descending passage inwardly thereof, undergoing the primary classification effected by the gas streams in the gas stream descending passage. Fine particles of the material resulting from the primary classification are subjected to the secondary classification effected by the rotation of the classifying blade rotor, and resulting fine particles are removed by way of the collecting passage whereas coarse particles are returned to the pulverizing chamber by way of the return passage.

An example of known classifying apparatus of this type is disclosed in U.S. Pat. No. 3,285,523 (or Japanese Patent Publication No. 50-21695). This known apparatus is described first with reference to FIG. 2 of the accompanying drawings. As seen, the apparatus has a classifying blade rotor 13 disposed inwardly of a guide ring 5. Material introduced by a feeder 4 is pulverized by a rotor 1, and resulting particles of the material are carried through a gas stream ascending passage 8 and then through a gas stream descending passage 9 by gas introduced from a gas feed duct 10. Fine particles resulting from a primary classification effected in the gas stream descending passage 8 are subjected immediately to a secondary classification effected by the action of the classifying blade rotor 13. Fine particles that pass through the classifying blade rotor 13 are removed by way of a collecting passage 14 whereas coarse particles emerging from the primary and secondary steps of classification are immediately returned to a pulverizing chamber 3.

According to this prior art arrangement, the primary classification and secondary classification are carried out in the same space, producing an unfavorable effect on each other to the detriment of classifying precision and efficiency. A further disadvantage of the known apparatus is that, since all of the coarse particles emerging from the classification are immediately returned to the pulverizing chamber, the pulverizing rotor 1 must operate under great load variations and is thus prone to bad pulverizing efficiency.

SUMMARY OF THE INVENTION

Having regard to the state of the art as noted above, the object of this invention is to provide an improvement in the apparatus to realize both pulverization and classification carried out with greater efficiency.

In order to achieve this object, a vertical type pulverizing and classifying apparatus according to this invention is characterized in that a conduit is provided to be substantially coaxial with the vertical axis for receiving fine particles of the material from the gas stream descending passage and sending the fine particles to a classifying chamber housing the classifying blade rotor, and the return passage includes a coarse material floating chamber defined circumferentially of the conduit to receive the coarse particles descending from the classifying chamber, and a transfer duct for feeding the coarse particles from the floating chamber to the coarse material pulverizing chamber by way of the feeder.

The above characterizing features of the invention produce the following effect:

Since the conduit is provided separating the gas stream descending passage in which the primary classification is effected and the classifying chamber in which the secondary classification is effected, there occurs no interference between the gas stream effecting the primary classification and the gas streams effecting the secondary classification. Thus necessary gas flow conditions are achieved in the gas stream descending passage and the classifying chamber easily and reliably, which is effective for improved classifying precision and efficiency.

Besides, since coarse particles are allowed to fall from the classifying chamber to the coarse material floating chamber, any aggregates of fine particles mixed into the coarse particles are broken up while flowing on the gas streams in the coarse material floating chamber and are lifted backed again to the classifying chamber by the gas streams. This feature too is effective to improve the classifying efficiency.

The improved classifying efficiency which is effective to check return of particles sufficiently reduced in size to the pulverizing chamber, leads to an improved pulverizing efficiency. In returning the coarse particles from the coarse material floating chamber to the pulverizing chamber, the coarse material floating chamber has an outgoing amount equalizing function to accommodate any great variations in the amount of coarse particles arriving from the classifying chamber and return the coarse particles in a constant amount to the pulverizing chamber, thereby assuring high pulverizing efficiency. Thus, the invention has successfully achieved an apparatus which is superior on the whole, in pulverizing efficiency, classifying efficiency and classifying precision.

According to one preferred embodiment of this invention, the coarse material floating chamber has a bottom face defined by a plate member including a plurality of pores through which the gas entering from the gas feed duct shoots upwardly. This construction permits the aggregates of fine particles to be broken up positively by the gas shooting up with vigor, which contributes toward improved classifying efficiency.

According to another preferred embodiment of the invention, the plate member is in a frustoconical form including pores only in a periphery thereof. This construction permits the aggregates of fine particles to fall along the conical wall by gravity and collect around the periphery below where the aggregates are broken up efficiently.

According to a further preferred embodiment, the entirety of the plate member is in a frustoconical form and inclined toward an inlet opening of the transfer duct. This construction permits coarse particles to move into the transfer duct smoothly and to be fed back to the pulverizing chamber in a reliable manner.

Other objects and advantages of the invention will be apparent from the following description.

DETAILED DESCRIPTION OF THE PREFERRED EMBODIMENTS

Figure 1:
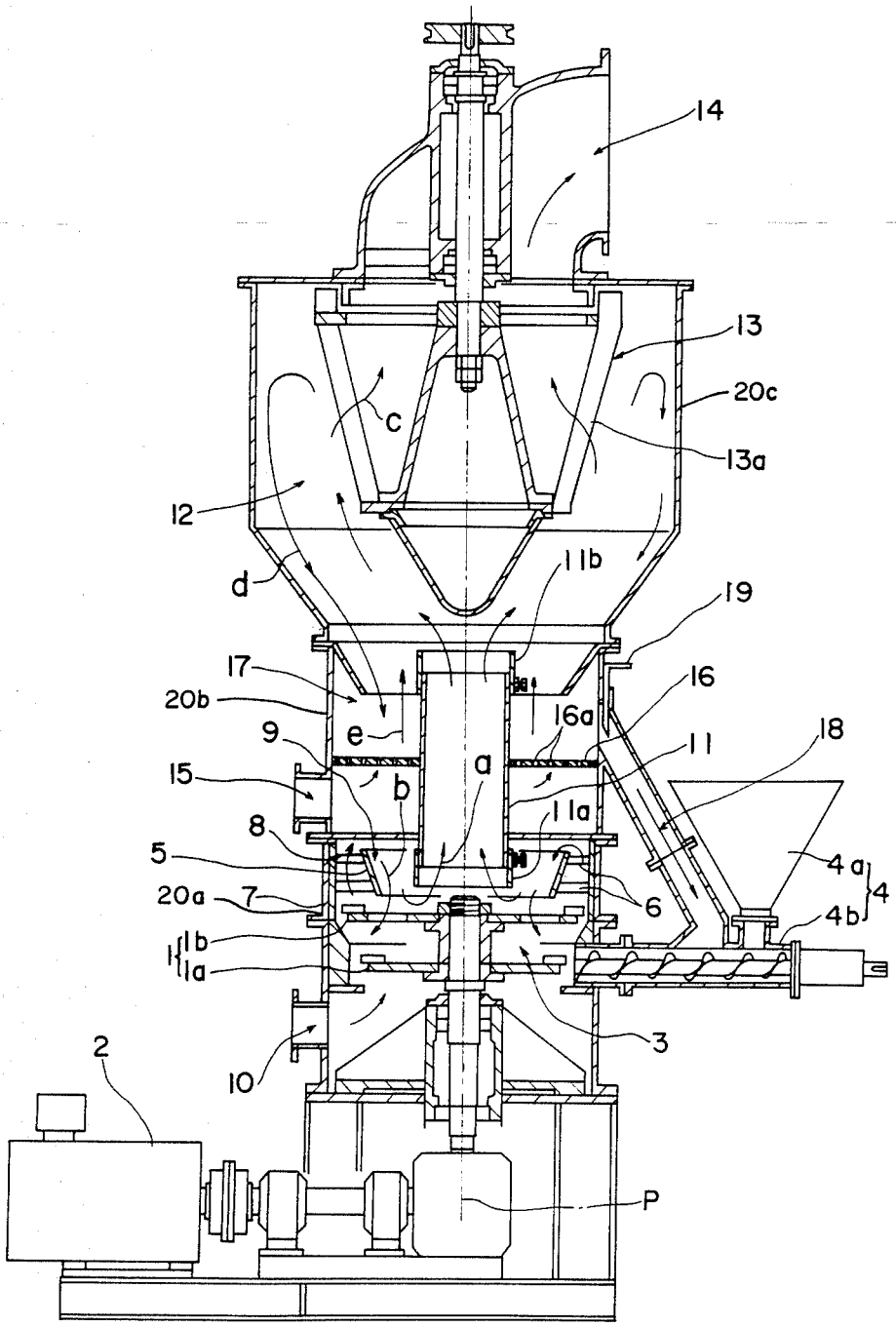
FIG. 1 is a schematic view in vertical section of an embodiment of this invention.
Figure 2:
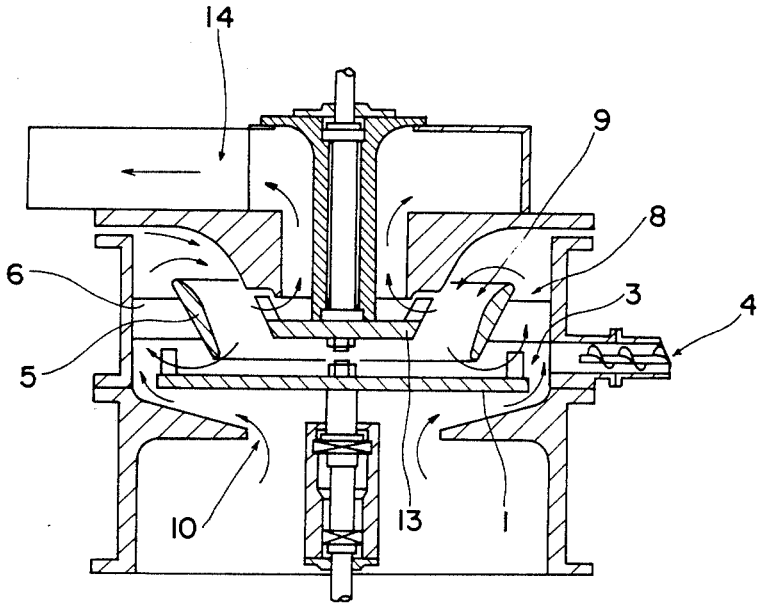
Fig. 2 (PRIOR ART)
FIG. 2 is a schematic view in vertical section of a prior art apparatus.

An embodiment of the invention is described with reference to FIG. 1. The apparatus shown comprises a pulverizing rotor 1 mounted in a pulverizing chamber 3 disposed in a lower housing portion 20*a* and including a small diameter rotor portion 1*a* consisting of a disc carrying a plurality of hammers and a large diameter rotor portion 1*b* consisting of a perforated disc carrying a plurality of hammers. The rotor 1 is driven by a motor 2 to rotate on a vertical axis P. A material feeder 4 including a hopper 4*a* and a rotatable screw conveyer 4*b* is connected to the pulverizing chamber 3, material to be treated being continuously fed in a constant amount into the chamber 3 to be pulverized therein by the rotor 1.

A guide ring 5 is attached by means of stays 6 to a case 7 substantially coaxial with the vertical axis P in a position within the pulverizing chamber 3 directly over the rotor 1. The guide ring 5 defines a gas stream ascending passage 8 exteriorly of the circumference thereof and a gas stream descending passage 9 inwardly thereof. A gas feed duct 10 is connected to the case 7 below the rotor 1. The material pulverized by the rotor 1 is carried by gas flowing in from the gas feed duct 10, through the gas ascending passage 8 and then through the gas descending passage 9.

A conduit 11 having extremities is mounted to be substantially coaxial with the vertical axis P, with a bottom thereof disposed in the guide ring 5. Part of the gas streams flow from the gas stream descending passage 9 into the conduit 11 as shown by arrows a, the remaining gas streams returning toward the pulverizing rotor 1 as shown by arrows b. The gas stream separation as above effects a primary classification of the material under treatment, whereby fine particles of the material are carried into the conduit 11 and coarse particles are returned to the rotor 1. The conduit 11 includes a lower portion 11 vertically adjustable by a bolts or the like to permit variations of a gas stream separation ratio, whereby a desired standard or criterion particle size may be determined for the primary classification.

A classifying chamber 12 is disposed within an upper housing portion 20*c* in communication with a top portion of the conduit 11, and a classifying blade rotor 13 is mounted therein which is driven by a motor (not shown) to rotate substantially on the vertical axis P. The classifying rotor 13 carries blades 13*a* to generate circular flows, and a space surrounded by the blades 13*a* is in communication at the top with a material collecting passage 14. Thus, while the material fed from the conduit 11 is made to flow round in the classifying chamber 12 by the action of the classifying blade rotor 13, the gas flows through spaces between the blades 13*a* as shown by arrows c, and into the collecting passage 14. At this time the material is subjected to a secondary classification provided by centrifugal force and a conveying force of the gas streams, whereby fine particles are drawn into the collecting passage 14 and coarse particles are allowed to fall through the classifying chamber 12 as shown by an arrow d. The conduit 11 includes an upper portion 11*b* vertically adjustable by bolts or the like to realize an optimal gas stream condition within the classifying chamber 12.

The apparatus further includes a return passage 17, 18 comprising a coarse material floating chamber 17 disposed in a medial housing portion surrounding an entire periphery of the conduit 11 and a transfer duct 18 extending from the coarse material floating chamber 17 to the feeder 4. The coarse material floating chamber 17 receives the coarse particles descending from the classifying chamber 12, and retains the coarse particles afloat of gas entering from a gas feed duct 15 and shooting upwardly through a plate member 16 defining a plurality of pores 16*a* such as a punched metal, a wire netting or the like. The transfer duct 18 permits the coarse particles to flow down to the feeder 4 by gravity. Thus the return passage 17, 18 receives the coarse particles from the classifying chamber 12 and returns them in a constant amount to the pulverizing chamber 3 while breaking up aggregates of fine particles mixed into the coarse particles and returning the fine particles on ascending gas streams as shown by arrows e. The transfer duct 18 is provided at an inlet opening thereof with a suitable damper 19 which opens sideways, upwardly or downwardly, and is preferably of the type with a variable overflow stopper height, whereby an amount of return coarse particles may be controlled as desired.

The described construction assures the function and advantages as set forth in the introductory part hereof, and provides improved pulverizing efficiency, classifying efficiency and classifying precision.

Modifications of this apparatus and different embodiments are described next.

Specific constructions of the pulverizing rotor 1, the material feeder 4 and the classifying blade rotor 13 are variable in many ways. The transfer duct 18 for feeding coarse particles from coarse material floating chamber 17 to the feeder 4 may be replaced by a constant feed type conveyer, for example. Further, the coarse particles may be transferred from the coarse material floating chamber 17 to the pulverizing chamber 3 by way of a feeder specially provided for the purpose instead of using the material feeder 4. However, the arrangement to feed the coarse particles to the pulverizing chamber 3 by way of the material feeder 4 as in the embodiment of FIG. 1 causes the coarse particles to mix with a fresh supply of the material with a result that the material feed to the pulverizing chamber for treatment becomes uniform, which contributes toward high pulverizing efficiency.

The plate member 16 need not be flat and horizontal as in the embodiment of FIG. 1, but may be modified in varied ways. For example, the member 16 may be inclined toward the inlet opening of the transfer duct 18 or may be in a frustoconical form or may be a combination of the transfer duct 18. The plate member 16 may define the pores 16*a* over an entire surface or only locally thereof. Varied modifications are possible by combining the shape of the plate member 16 and the position of the pores 16 as desired. For example, an entirety of the frustoconical member may be inclined toward the inlet opening of the transfer duct 18, with the pores 16*a* defined only around a lower portion of its conical part, i.e. only at positions adjacent a wall of the coarse material floating chamber 17. Moreover, the plate member 16 may not include pores at all, in which case the gas feed duct 15 is connected directly to the coarse material floating chamber 17.

Generally speaking, the gas introduced from the gas feed ducts 10 and 15 comprises air, but may comprise any suitable gas such as nitrogen gas, or carbon dioxide gas, according to the nature of the material to be treated by the apparatus. One may utilize hot gas in order to dry the material in parallel with the pulverizing and classifying operations. The described apparatus is not limited in respect of the material to be treated thereby.

We claim:

1. A vertical type pulverizing and classifying apparatus comprising:

a pulverizing chamber provided with a pulverizing rotor disposed within a housing having upper, medial and lower portions, a guide ring stationarily disposed above and coaxially with the pulverizing rotor, the guide ring defining inwardly thereof a descending gas stream passage for primary classification of material pulverized in the pulverizing chamber, a classifying blade rotor disposed above and coaxially with the guide ring and driven so as to rotate within an upper housing portion, the blade rotor and the upper housing portion serving to define a classifying chamber therebetween for secondary classification of material fed from the guide ring, a collecting passage disposed above the blade rotor into which fine particles from the classifying chamber flow is fed by gas streams, a first material carrying gas feed duct disposed below the pulverizing rotor, a plate member provided with pores disposed between the descending gas stream passage and the classifying chamber and arranged to serve as a partition therebetween, a conduit having extremities axially disposed such that one extremity terminates within a zone defined by the guide ring and the opposite extremity extends through the plate member so as to terminate within the classifying chamber, a second gas feed duct disposed below the plate member and arranged to supply a flow of gas to the pores of said plate member, a coarse material floating chamber disposed within said medial housing portion above the plate member, said chamber being defined by said medial housing portion and the upper extremity of the conduit, and return passage means disposed exteriorly of said housing and extending from coarse material floating chamber to said lower housing portion and into said pulverizing chamber, whereby coarser particles are separated from finer particles and recylced for further pulverizing.

2. An apparatus as claimed in claim 1, further wherein said return passage means comprises a transfer duct connected to a material feeder, the coarser particles being fed from the coarse material floating chamber to the pulverizing chamber thereby.

3. An apparatus as claimed in claim 1 characterized in that the plate member (16) is in a frustoconical form defining the pores (16*a*) only in a periphery of a conical part thereof disposed downwardly.

4. An apparatus as claimed in claim 3, further wherein said return passage means comprises a transfer duct connected to a material feeder, the coarser particles being fed from the coarse material floating chamber to the pulverizing chamber, thereby.

5. An apparatus as claimed in claim 3 characterized in that an entirety of the frustoconical plate member (16) is inclined toward an inlet opening of the transfer duct (18).

6. An apparatus as claimed in claim 5, further wherein said return passage means comprises a transfer duct connected to a material feeder, the coarser particles being fed from the coarse material floating chamber to the pulverizing chamber thereby.

* * * * *